US007275341B1

(12) United States Patent
Kincaid

(10) Patent No.: US 7,275,341 B1
(45) Date of Patent: Oct. 2, 2007

(54) PLANT MARKER

(75) Inventor: Gary L. Kincaid, Savannah, MO (US)

(73) Assignee: Kincaid Gardens, Inc., Savannah, MO (US)

( * ) Notice: Subject to any disclaimer, the term of this patent is extended or adjusted under 35 U.S.C. 154(b) by 16 days.

(21) Appl. No.: 11/419,777

(22) Filed: May 23, 2006

(51) Int. Cl.
*A47G 7/00* (2006.01)

(52) U.S. Cl. ..... 40/645

(58) Field of Classification Search ..... 248/153, 248/156, 688, 87; 40/606.14, 607.03, 645, 40/657, 661.03, 669
See application file for complete search history.

(56) References Cited

U.S. PATENT DOCUMENTS

| | | | | |
|---|---|---|---|---|
| 1,616,147 | A | 2/1927 | Smiley | |
| 2,048,906 | A * | 7/1936 | Webster | 40/645 |
| 2,269,087 | A * | 1/1942 | Schramm | 40/669 |
| 2,461,054 | A * | 2/1949 | Green | 40/645 |
| 2,556,124 | A * | 6/1951 | Ullrich | 248/153 |
| 2,595,530 | A * | 5/1952 | Kuefner | 40/645 |
| 2,835,994 | A | 5/1958 | Kuefner | |
| 2,857,695 | A | 10/1958 | Goetting | |
| 2,894,706 | A * | 7/1959 | Cappio | 248/87 |
| 3,684,224 | A * | 8/1972 | Kwako | 248/87 |
| 5,088,666 | A * | 2/1992 | Lang | 248/87 |
| 5,259,134 | A * | 11/1993 | Cohen | 40/642.01 |

OTHER PUBLICATIONS http://www.eonindustries.com/eseries.html, Jun. 7, 2002.
http://www.everlastlabel.com/catalog.htm, Mar. 9, 2001.

* cited by examiner

*Primary Examiner*—Lesley D. Morris
*Assistant Examiner*—Shin Kim
(74) *Attorney, Agent, or Firm*—Invention Protection Associates, LLC

(57) ABSTRACT

A plant or garden marker assembly comprising a ground stake element, preferably constructed of rigid metal wire, and an identification plate element, preferably fabricated of sheet metal. A decal is applied to a flat portion of the plate for purposes of plant identification. Flanged front and rear sections of the plate feature holes through which the stake is threaded to enable the plate to be friction mounted thereupon. The plate may also be detached from the stake, allowing a single stake to be used with different plates displaying various plant identifications.

12 Claims, 5 Drawing Sheets

PLANT MARKER

This application claims the benefit of the filing of application 29/246,627.

BACKGROUND OF THE INVENTION

The present invention generally relates to a marker, and it is specifically directed an improved plant marker assembly comprised of a ground stake element and a detachable identification plate element.

The prior art is replete with apparatuses that are driven into the ground for the purpose of identifying plants and vegetation growing within their vicinity. Some of these known plant markers are simply single piece articles comprising both ground anchoring and plant identification sections. U.S. Pat. No. D483,410 to Overdevest, et al., for example, illustrates a plant identification marker of such singular construction. However, a drawback of many unitary prior art markers is that they are not adapted for use in identifying different species of plants. More specifically, when a marker's anchoring part is inseparably integrated with its plant indicia-bearing part, that particular marker likely can be used to identify only a single type of plant, thus, requiring a user to acquire potentially several markers for identifying several different plants.

There are other prior art plant markers that feature slots or pockets for fitting relatively flat pieces of plant identifying indicia within. For instance, U.S. Pat. Nos. 2,835,994 to Kuefner and 4,534,125 to Buck disclose a marker apparatuses that include indicia holders fabricated of transparent material, wherein the holders have pockets that plant identification cards or seed packets can be slid into. U.S. Pat. No. 5,044,200 to Dailey, et al. discloses another marker that, although configured quite differently, also comprises a holder component for inserting an identification sign into. However, because the pocket parts of many of these types of assemblies can be constantly exposed to the environment, they often are susceptible to mold formation or corrosion that can affect transparency of the material through which a pocketed sign or other form of plant indicia is to be viewed. Furthermore, particularly because of their size dimensions, these holding spaces can be inconvenient, if not difficult, to clean.

Still other known plant markers incorporate identification bearing components that are removably affixed to their ground anchoring parts, as is true of the present invention. Generally, plant markers of this construct are beneficial to consumers in that they allow a single anchor, or stake, to be used interchangeably with multiple different identification plates, signs or holders. Thus, when a plant identification part of a marker assembly becomes deteriorated or otherwise undesirable, a consumer need only replace that identification part and not the stake part. Nevertheless, despite this advantage, depending upon specifically how a removable identification part of a plant marker is to be affixed to the stake part (i.e., by friction therebetween, a locking mechanism, etc.), there may exist the possibility of the two parts becoming inadvertently detached, especially due to wind effects or extensive wear.

Therefore, it can be appreciated that there exists a need for an improved plant marker comprised of a stake and a plant identification plate that is removably mounted thereto, together constructed so as to eliminate the likelihood of the plate accidentally separating from the stake and configured so as to reduce the possibility of wind knocking over the marker. The plant marker of the present invention substantially fulfills this existing need.

SUMMARY

The present invention is an improved plant or garden marker apparatus. The constituent components of a preferred embodiment of the invention include a stake element for anchoring the apparatus to the soil, a display member that is removably affixed to the stake and plant identifying indicia applied to the display member. The stake is a rigid wire with a multiply bent configuration. More specifically, the wire is arcuately bent at its center, forming a proximal end of the stake and a pair of legs extending therefrom. Additionally, a pair of symmetrical bends along the legs forms a display mounting segment of the stake which is in angled relation to the segment to be driven into the ground. The display member is a sheet of material with flanged end portions. Most importantly, its flange oriented closest to the aforementioned proximal end of the stake contains a single elongated hole for projecting the proximal end and both legs of the stake through, while the opposite flange contains two separate circular holes for accommodating the two legs of wire individually. Finally, the identifying indicia comprise a decal or other means for identifying a plant growing in the vicinity of where the apparatus is set.

Because of the bends in the wire stake and the configuration of the flanged and apertured display member, once the display member is properly mounted upon the stake, it cannot slide completely off the proximal end of the display mounting segment of the stake, nor can it travel off its opposite end without being purposely manipulated.

It is, therefore, an object of the present invention to provide a plant marker assembly that allows for different plant identifying components to be used interchangeably with a single ground anchoring component.

It is another object of the invention to provide a plant marker that includes a plant identifying component which can be mounted to and dismounted from a ground stake component by manual manipulation, but which is highly unlikely to ever become detached from the stake without human intervention or otherwise unintentionally.

Finally, it is yet another object of the present invention to provide a plant marker of a configuration which is sufficiently aerodynamic to resist being toppled by wind gusts. In fact, by employing a stake constructed of wire and a display member that sits inclined upon the stake, the marker presents minimal surface area that is exposed to wind.

DETAILED DESCRIPTION OF THE PREFERRED EMBODIMENTS

Figure 2:
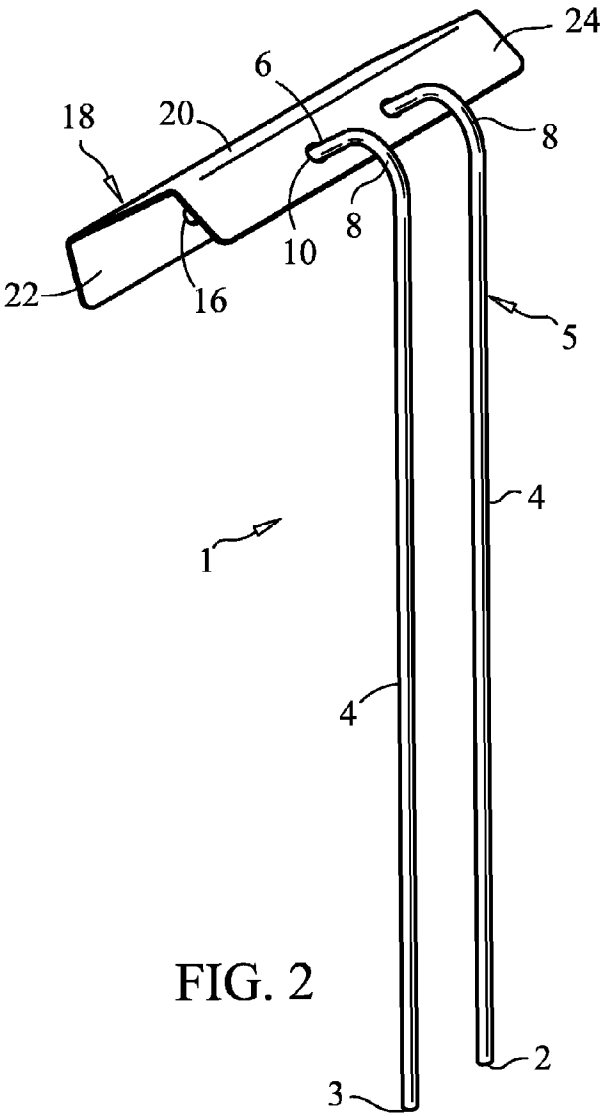
FIG. 2 is a rear perspective view of the plant marker.
Figure 1:
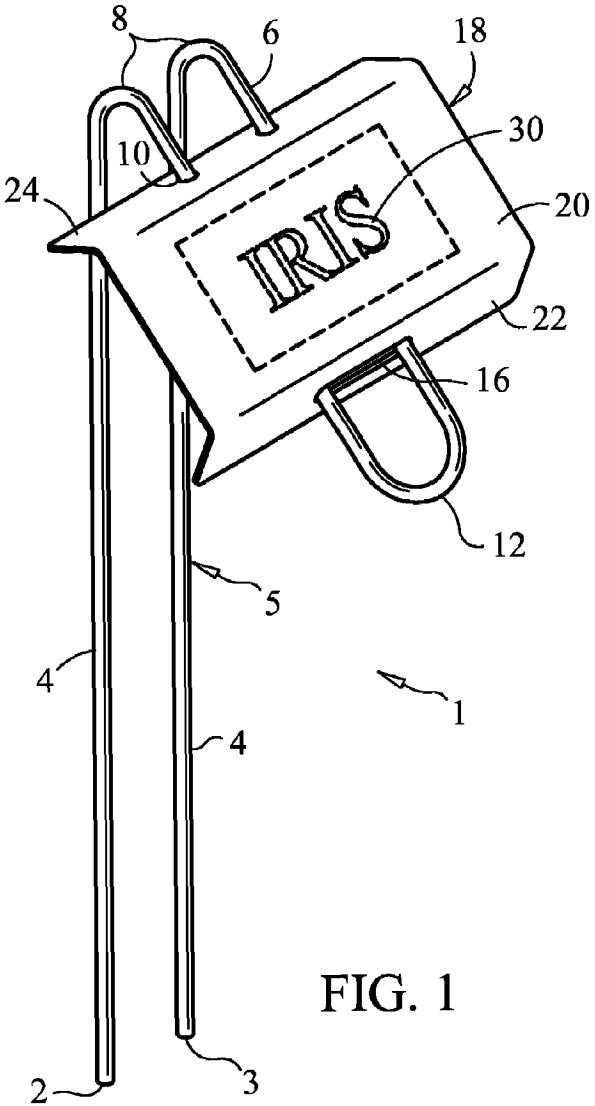
FIG. 1 is a front perspective view of the plant marker of the present invention.
Figure 4:
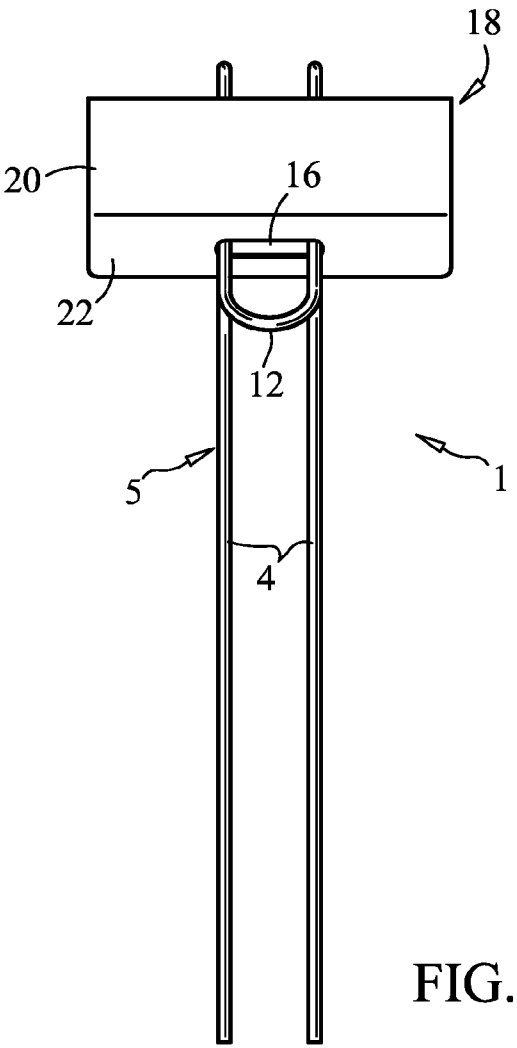
FIG. 4 is a front elevational view of the plant marker.
Figure 3:
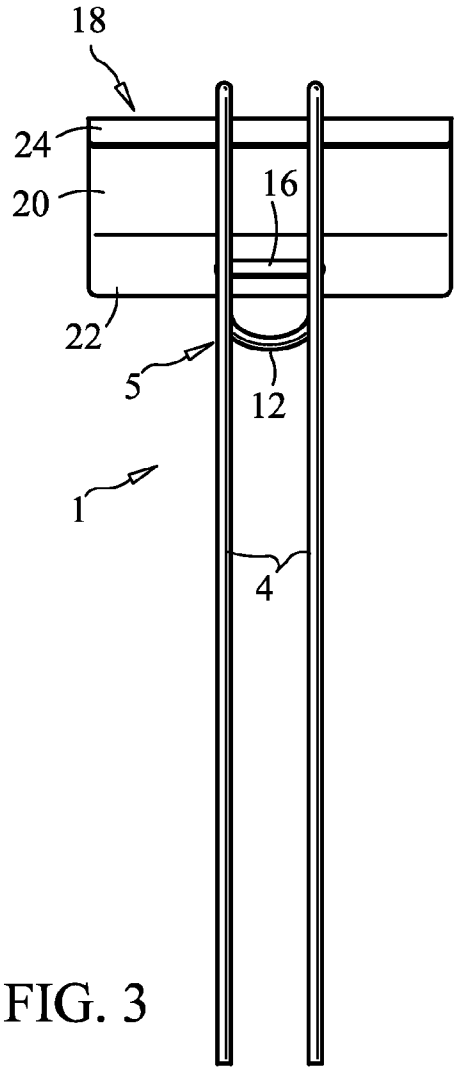
FIG. 3 is a rear elevational view of the plant marker.
Figure 6:
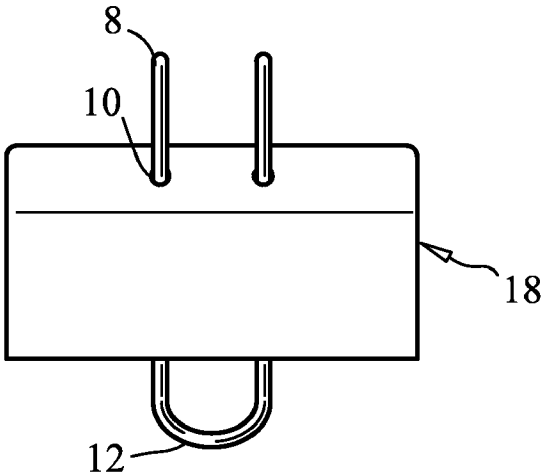
FIG. 6 is a top plan view of the plant marker.
Figure 5:
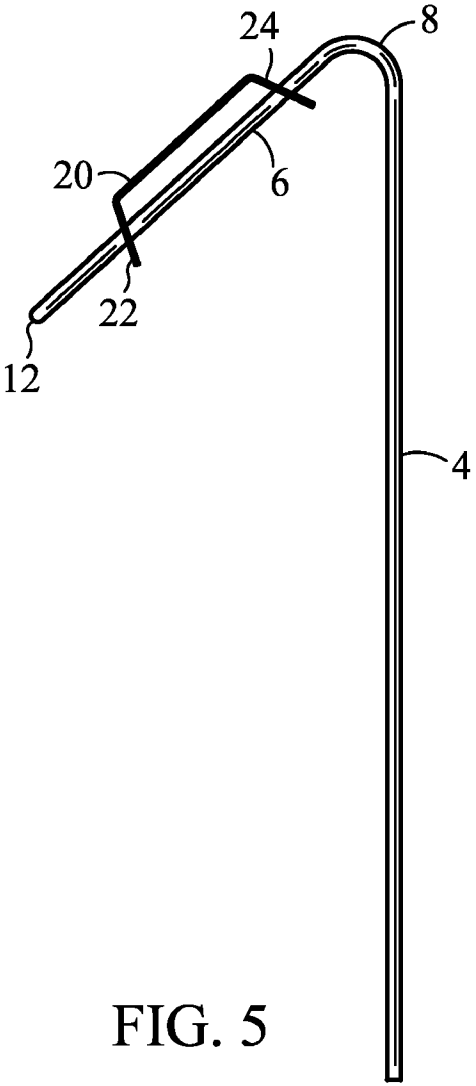
FIG. 5 is a right side elevational view of the plant marker.
Figure 9:
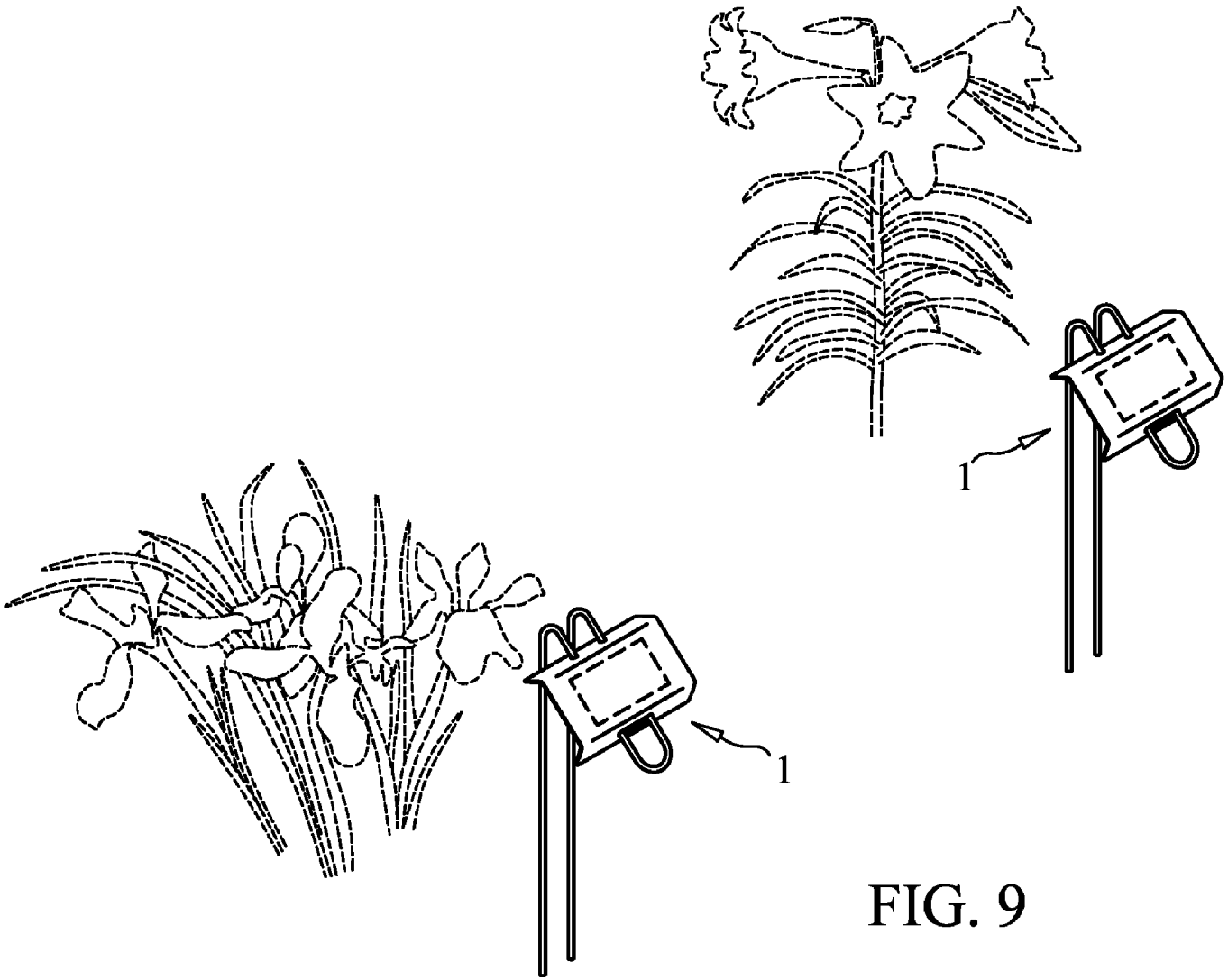
FIG. 9 is a top and front perspective view showing two separate plant markers of the present invention.

A preferred embodiment of the plant marker of the present invention is best illustrated in FIGS. 1 and 9. Such an embodiment of the marker 1 is comprised of three assembled elements: a ground stake 5, a display plate 18 and identifying indicia 30.

The stake 5 is a wire rod constructed of a rust resistant material such as aluminum, stainless steel, zinc or molded hard plastic. Midway between the wire's two ends 2, 3 is a semicircular bend 12 which separates the stake wire into two legs. Along the legs, approximately one-third of the distance from the aforementioned bend 12 to the respective leg ends 2, 3, are a pair of symmetrical bends 8. These bends 8 effectively subdivide the stake 5 into a plate mounting portion 6 and a ground anchoring portion 4. Preferably, the distal bends 8 put the mounting portion 6 and anchoring portion 4 in approximately 45-degree relation to each other. This angled configuration allows persons to view the display from a horizontal distance while still rendering relatively little surface area of the plate 18 susceptible to horizontal wind pressure.

Figure 7:
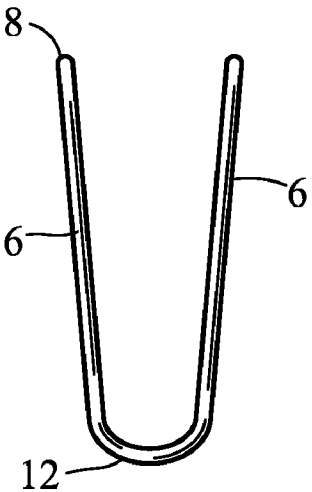
FIG. 7 is a top plan view of the ground stake component shown isolated from the display plate component of the plant marker.

The stake's mounting portion 6 is defined as the semi-loop of wire spanning from one symmetrical bend 8 to the other 8. Thus, the semicircular bend 12 forms a proximal end of the mounting portion 6, and the two symmetrical bends 8 form its distal ends. As shown in FIG. 7, when the display plate 18 is detached from the stake 5, the wire legs are slightly divergent throughout their mounting portion 6. Yet, flexibility of the proximal bend 12 allows the legs to be manually squeezed into parallel relation for easily mounting and dismounting the plate 18. The stake's anchoring portion 4 is defined as the generally parallel and vertically upright segments of wire continuing from each of the distal bends 8 to the wire ends 2, 3. As can be gleaned from FIG. 9, the anchoring portion 4 of the stake is to be driven into the soil in the vicinity of a plant.

The display plate 18 is a thin sheet of rigid material having a flat middle portion 20 situated between flanged opposing end portions 22, 24. Each flange is a downwardly bent section of the plate 18 that is sufficiently broad to contain a hole(s) for guiding the stake's mounting portion 6 through. To with, centered in the plate's proximal flange 22 is a horizontally elongated hole 16, and in its distal flange 24 are a matching pair of circular holes 10, each having a slightly larger diameter than does its occupying stake wire. Additionally, these two distal holes 10 are horizontally spaced so as to align with the opposing horizontal ends of the single proximal hole 16.

Located on the middle portion 20 of the plate 18 is identifying indicia 30 which, preferably, is a decal. However, the indicia 30 may be a plant-identifying sheet of material affixed to the middle portion 20 by adhesive tape, magnetism or other means, or it may be simply writing that is directly on the plate 18.

When the display plate 18 is fixedly secured to the stake 5, its elongated proximal hole 16 is occupied by both wire legs of the stake's mounting portion 6, and each of its distal holes 10 is occupied by a separate leg of the mounting portion 6. Accordingly, the divergent disposition of the mounting portion of the stake legs 6 creates binding friction between the stake 5 and plate 18 precisely at the respective outer edges of the distal holes 10. Furthermore, even if that friction is diminished because of wear and the display plate 18 starts tending to inadvertently slide down the mounting portion 6, the plate 18 will never completely detach from the stake 5. Instead, the plate 18 will always remain suspended in an effective position because the proximal bend 12 will retain the display member's distal flange 24. Additionally, while the stake 5 is occupying the holes in both plate flanges 22, 24, the plate 18 will not travel off the mounting portion 6 of the stake in the opposition direction either (i.e., it will not slide down the anchoring portion 4), because the rigid display plate 18 simply cannot negotiate the symmetrical bends 8.

Figure 8:
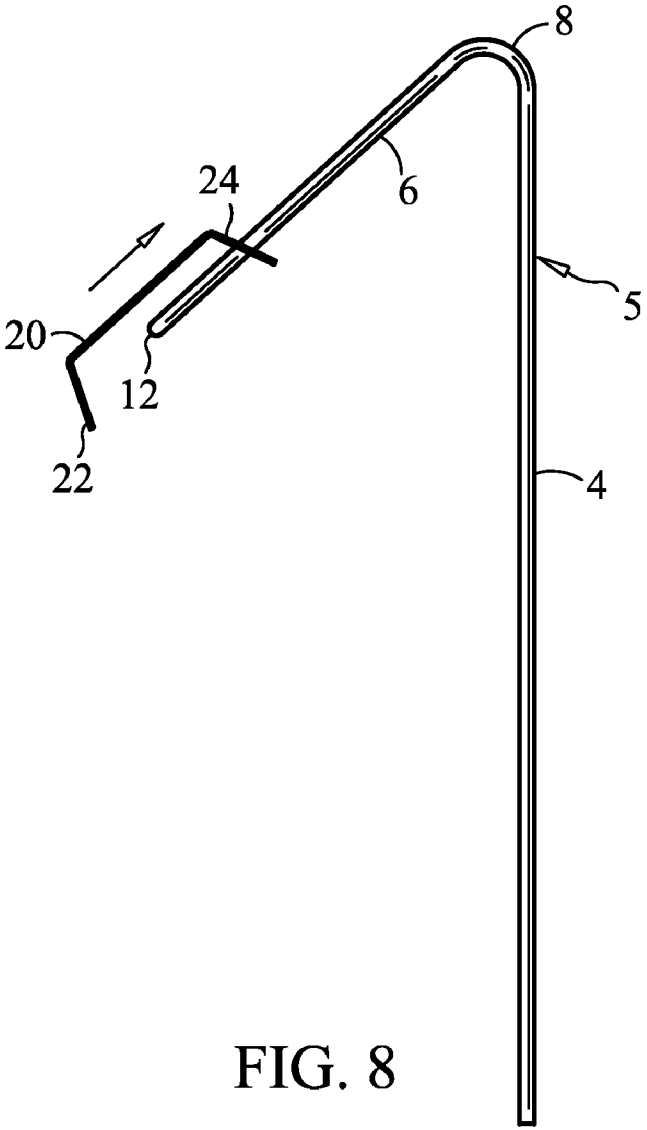
FIG. 8 is a right side elevational view of the plant marker while the display plate is partially detached from the ground stake.

Therefore, in order to remove the plate 18 from the stake 5, one must: (1) pinch the mounting portion of the stake legs 6 into parallel or even convergent relation, thereby reducing friction between the plate 18 and stake 5; (2) slide the plate 18 down the mounting portion 6 until the plate's proximal flange 22 disengages the stake 5 as shown in FIG. 8; and (3) with the proximal flange 22 remaining disengaged, reversely slide the distal flange 24 up the mounting portion, over the distal bends 8 and down and off the anchoring portion 4. Thus, one can advantageously acquire a number of display plates 18 and a separate number of ground stakes 5 in accordance with his actual quantitative need for each.

Although the present invention has been described in considerable detail and with reference to and illustration of a preferred version, it should be understood that other versions are contemplated as being part of the present invention.

What is claimed is:

1. A plant marker apparatus comprising:

a stake for affixing the apparatus to the ground;

a plate for bearing plant identification, the plate having proximal and distal flanges for removably mounting the plate to the stake;

at least one distal aperture residing in the distal flange, the distal aperture(s) for receiving the stake; and an elongated proximal aperture residing in the proximal flange, the proximal aperture also for receiving the stake.

2. The apparatus of claim 1, further comprising identifying indicia applied to said plate.

3. The apparatus of claim 1, wherein said stake comprises:

a wire rod;

a proximal bend at the approximate center of the rod;

a pair of legs formed about the proximal bend; and distal bends in the legs, wherein the distal bends are generally symmetrical.

4. The apparatus of claim 3, wherein said plate is frictionally attachable to said stake and wherein said distal bends in the stake are bent such that said plate is prevented from traveling over said distal bends when the proximal aperture and the distal aperture(s) in the plate are occupied by said stake, but wherein said plate may be slid over said distal bends when the proximal aperture is not occupied by said stake.

5. The apparatus of claim 3, wherein the respective segments of said legs that lie between said proximal bend and said distal bends are nonparallel.

6. The apparatus of claim 3, wherein said distal bends are approximately 45-degree bends.

7. A plant marker apparatus comprising:

a stake for affixing the apparatus to the ground;

a display member for bearing plant identification, the display member being removably mountable to the stake;

at least one distal aperture residing in the display member, the distal aperture(s) for receiving the stake; and a proximal elongated aperture residing in the display member, the proximal aperture also for receiving the stake.

8. The apparatus of claim 7, further comprising identifying indicia applied to said display member.

9. The apparatus of claim 7, wherein said stake comprises:

a wire rod;

a proximal bend at the approximate center of the rod;

a pair of legs formed about the proximal bend; and distal bends in the legs, wherein the distal bends are generally symmetrical.

10. The apparatus of claim 9, wherein said display member is frictionally attachable to said stake and wherein said distal bends in the stake are bent such that said display member is prevented from traveling over said distal bends when said proximal and distal apertures in the display member are occupied by said stake, but wherein said display member may be slid over said distal bends when said proximal aperture is not occupied by said stake.

11. The apparatus of claim 9, wherein the respective segments of said legs that lie between said proximal bend and said distal bends are nonparallel.

12. The apparatus of claim 3, wherein said distal bends are approximately 45-degree bends.

* * * * *